United States Patent [19]

Miller

[11] 4,329,103

[45] May 11, 1982

[54] BUCKET LOADER ATTACHMENT

[76] Inventor: Lester E. Miller, Rte. #1, Box 333, Hegins, Pa. 17938

[21] Appl. No.: 190,343

[22] Filed: Sep. 24, 1980

[51] Int. Cl.[3] ..... E02F 3/80

[52] U.S. Cl. ..... 414/24.5; 37/117.5; 172/253; 414/724

[58] Field of Search ..... 414/24.5, 24.6, 607, 414/608, 722, 723, 724, 785; 37/117.5, DIG. 3; 172/245, 247, 250, 251, 253; 24/298, 299

[56] References Cited

U.S. PATENT DOCUMENTS

| | | | |
|---|---|---|---|
| 3,249,245 | 7/1966 | Foster | 414/724 |
| 3,312,361 | 4/1967 | Foster | 414/724 |
| 3,587,887 | 10/1971 | DeCarli | 414/724 X |
| 3,665,622 | 5/1972 | Lamb | 37/117.5 |
| 3,812,979 | 5/1974 | Leihgeber | 37/117.5 X |
| 3,866,342 | 2/1975 | Cooper | 37/117.5 |
| 3,921,837 | 6/1975 | Vanderwater | 414/724 |
| 4,015,739 | 5/1977 | Cox | 414/684 X |
| 4,073,175 | 2/1978 | Seamon | 414/607 |
| 4,099,629 | 7/1978 | Cox | 414/684 X |
| 4,120,405 | 9/1978 | Jones et al. | 414/24.5 |
| 4,179,034 | 10/1979 | Van Antwerp et al. | 414/551 |
| 4,275,985 | 6/1981 | Schremmer | 414/724 X |

FOREIGN PATENT DOCUMENTS

| | | | |
|---|---|---|---|
| 748739 | 4/1933 | France | 414/607 |

*Primary Examiner*—Leslie J. Paperner
*Attorney, Agent, or Firm*—Michael R. Swartz

[57] ABSTRACT

A quick connect-disconnect bucket attachment for providing versatility to a front-end loader. The attachment includes an upright frame structure adapted to rest on the floor of the bucket and which is provided with a pair of slotted brackets for releasably receiving the front edge of the bucket floor. A pair of chains connect the top of the frame structure to the bucket, the rearward ends of the chains being looped around a pair of transversely spaced hooks mounted on the top edge of the rear wall of the bucket. A turnbuckle is employed to apply tension to the chains so as to firmly anchor the attachment on the bucket such that the attachment acts as an integral extension of the loader. A load support member in the form of a large round bale engaging tine or in the form of a boom arm projects forwardly from the upper portion of the frame structure for supporting a load on the bucket and thus converting the bucket loader to other desired uses.

12 Claims, 5 Drawing Figures

BUCKET LOADER ATTACHMENT

BACKGROUND OF THE INVENTION

1. Field of Invention

The present invention relates to an attachment for a front-end loader, and, more particularly, is directed to an attachment device which can be readily connected and disconnected to the bucket of a front-end loader in thereby converting the bucket loader for other uses.

2. Description of the Prior Art

A front-end loader, often referred to as a bucket loader, is a widely used, commonly known piece of equipment found in many commercial and industrial applications, such as in construction and excavating operations, as well as in many agricultural applications, such as in farming and livestock operations. Bucket loaders are of various sizes and configurations, but basically include a prime mover, such as a tractor or the like, having a pair of pivotally supported lift arms that are hydraulically driven to raise and lower a bucket attached to the ends of the lift arms. Normally, a hydraulic cylinder is also used to pivot the bucket about a horizontal axis so as to move the bucket from a load receiving to a load discharging position, and vice versa. The primary use or function of a bucket loader is to transfer bulk materials, such as sand, gravel, earth, manure, etc., from one location to another. For example, bucket loaders are used in livestock operations for scooping manure from the livestock pens and loading same on a spreader, while in construction operations a bucket loader is used to load gravel from a pile onto a dump truck.

Due to the large investment of a bucket loader and for convenient reasons, it has been common practice to convert bucket loaders to perform operations other than the transferring of bulk materials. This practice adds versatility to the loader and thereby eliminates the need and associated costs for using separate pieces of equipment or tools to perform these separately desired operations.

One example of such a converted use of a bucket loader is illustrated by U.S. Pat. No. 3,249,245 (Foster) wherein there is shown a converter unit that attaches to the bucket of the loader in thereby providing an auxiliary tongue or hitch for towing machinery from the front of the bucket loader. The Foster converter unit includes a rigid, forwardly projecting, beam which has its rear end pinned to the rear wall of the bucket and with its forward end being supported above the floor of the bucket by a vertical column and a pair of diagonal support members. The lower end of the column and the support members are provided with slotted brackets that engage fore-and-aft extending fork tines which are disposed adjacent the floor of the bucket. The cooperation of the slotted brackets in engagement with the fork tines in conjunction with the pin connection of the beam to the rear wall provide the necessary attachment for supporting the converter unit on the bucket.

Another type of bucket loader converter can be seen in U.S. Pat. No. 3,587,887 (De Carli). Shown is a converter unit that converts the bucket loader from a bulk material handling device to a boom structure device adapted to raise and lower construction pipe into a drainage trench. This converter device is similar to the one shown in the above Foster 3,249,245 patent being comprised of a rigid beam which is attached to the rear wall of the bucket by a pin and which further includes two forwardly projecting support members secured to the forward end of the rigid beam with lower ends that are slotted or so shaped to receive therebetween the floor of the bucket. Again, the pin connection of the rigid beam to the rear wall along with the slotted engagement of the support members with the floor provide the necessary attachment of the converter unit on the bucket.

Although not necessarily limited thereto, the converter units set forth in both the Foster 3,249,245 and DeCarli 3,587,887 patents are examples of bucket loader converters typically found in commercial industrial applications.

Another area where bucket loader conversion units are commonly found is in farming and livestock operations. With the recent advent and enormous popularity of the round bales, the need by farmers and livestock operators for a specific tool to handle and transport these large round bales produced by the round baler was created. In response to this need, several different types of round bale handling machines and devices were introduced into the market place. Some of these large round bale handlers are large, bulky, complex and expensive machines capable of transporting several large round bales at one time, whereas, other bale handlers are more simple in structure, being less costly, and usually transport only one large round bale at a time. Generally, these latter bale handlers cooperate or work in conjunction with another piece of machinery or tool which the farmer or livestock operator already has on his farm, such as a pick-up truck, a tractor, a front-end or bucket loader.

One example of such a large round bale handler can be seen in the Cox patents (U.S. Pat. Nos. 4,015,739 and 4,099,629). Cox's bale handler is of the type which operates in conjunction or combination with the three-point hitch of a farm tractor or can be operated on the bed of a pick-up truck. U.S. Pat. No. 4,179,034 shows another type of round bale handler that is designed to be used in combination with a pick-up truck.

U.S. Pat. No. 4,120,404 is illustrative of still another type of round bale handler. Shown is an attachment structure having three spear-shaped bale engaging prongs and which is designed to be attached either to the three-point hitch of a tractor or to a front-end loader that is mounted on the tractor. For attaching the bale handling device to the front-end loader, the bucket must first be removed and then the bale handler attaches to the lift or boom arms of the loader.

Yet another type of round bale handler is seen in U.S. Pat. No. 3,921,837. The round bale handler shown here is adapted for assembly with the bucket of the loader and basically includes a pair of forks that are attached by brackets to the sidewalls of the bucket.

The above-described commercial and agricultural bucket loader conversion units or attachments all suffer from various shortcomings. Although some of these conversion attachments have advantages over other ones and certain ones have specific disadvantages, it can be concluded that there exists a need for an improved bucket loader conversion attachment which can easily and quickly be connected to and disconnected from the bucket loader without first removing the bucket so as to readily convert the bucket loader for other uses. The uses may include, but are not limited to, the handling of large bales, the maneuvering of drainage pipe or the like in a construction operation, or the moving of equipment from one location to another as is customarily performed by a machinery dealer that moves his machinery about the machinery lot for one reason or another.

SUMMARY OF THE INVENTION

Accordingly, it is one of the principal objects of the present invention to provide a converter unit attachment for a bucket loader which can be easily and rapidly connected and disconnected on the bucket so as to add versatility to the loader.

Another object of the present invention is to provide a conversion attachment for a bucket loader which when attached to the bucket acts as an integral extension of the bucket.

Yet another object of the present invention is to provide a bucket loader conversion attachment which is sturdy in structure, simple in design and economical to manufacture.

In furtherance of these and other objects, the present invention sets forth an improved bucket loader conversion attachment adapted to be releasably secured to the bucket of a front-end loader. The conversion attachment includes a generally upright frame structure having a lower rectangular base portion which is adapted to rest on the floor of the bucket. Mounted on an upper portion of the frame structure and projecting forwardly therefrom is a load support member for supporting a load on the loader. In one embodiment, the load support member takes the form of a spear-shaped tine which is adapted to engage a large round bale or the like for transport thereof by the loader. In an alternative embodiment, the load support member takes the form of a boom arm or boom structure adapted for use as a lift or hoist for raising and lowering of loads from one location to another location. The load support member may either be rigidly mounted to the frame structure or may be removeably mounted to the frame structure so that one load support member adapted to perform one type of operation, such as boom arm for lifting, may be interchanged with another type of load support member, such as a large round bale engaging tine, for performing a different type operation. Such removable mounting of the load support member offers the advantage of having only one converter attachment that performs several separate operations.

The converter attachment further includes means mounted on the lower base portion of the frame structure and adapted to receive the front edge of the floor of the bucket and flexible link means adapted to interconnect the upper portion of the frame structure to the bucket. Preferably, the front edge of the bucket floor is received by a pair of slotted brackets, one bracket being attached to each opposite lateral side of the frame structure. In the preferred embodiment, the interconnecting flexible link means takes the form of a pair of chains, with one chain extending from the upper portion of the frame structure diagonally rearwardly toward one side of the bucket and with the other chain extending diagonally rearwardly from the frame structure to the other side of the bucket. For providing stability, it is preferable that the transverse spacing between the rearward ends of the chains be greater than the transverse spacing of the forward ends of the chains. Furthermore, for convenience and for providing the rapid connect and disconnect operations, the rearward ends of the chains are looped around or hooked about a pair of transversely spaced hooks mounted on the top edge of the rear wall of the bucket.

For firmly anchoring the converter attachment on the bucket such that the load support member acts as an integral extension of the bucket, tensioning means, preferably in the form of a turnbuckle, is provided to adjust the tension in the chains between a taut mode wherein the frame structure is firmly anchored on the bucket and a slack mode wherein the chains are relaxed to thereby facilitate removal of the converter attachment from the bucket.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the drawings in which.

DETAILED DESCRIPTION OF THE INVENTION

In the following description, right-hand and left-hand references are determined by standing at the rear of the machine facing in a direction of forward travel. Also, in the following description, it is to be understood that such terms, as "forward", "rearward", "left", "right", "upwardly", "downwardly", and the like are words of convenience and are not to be construed as limiting terms.

DESCRIPTION OF PREFERRED EMBODIMENT

Figure 1:
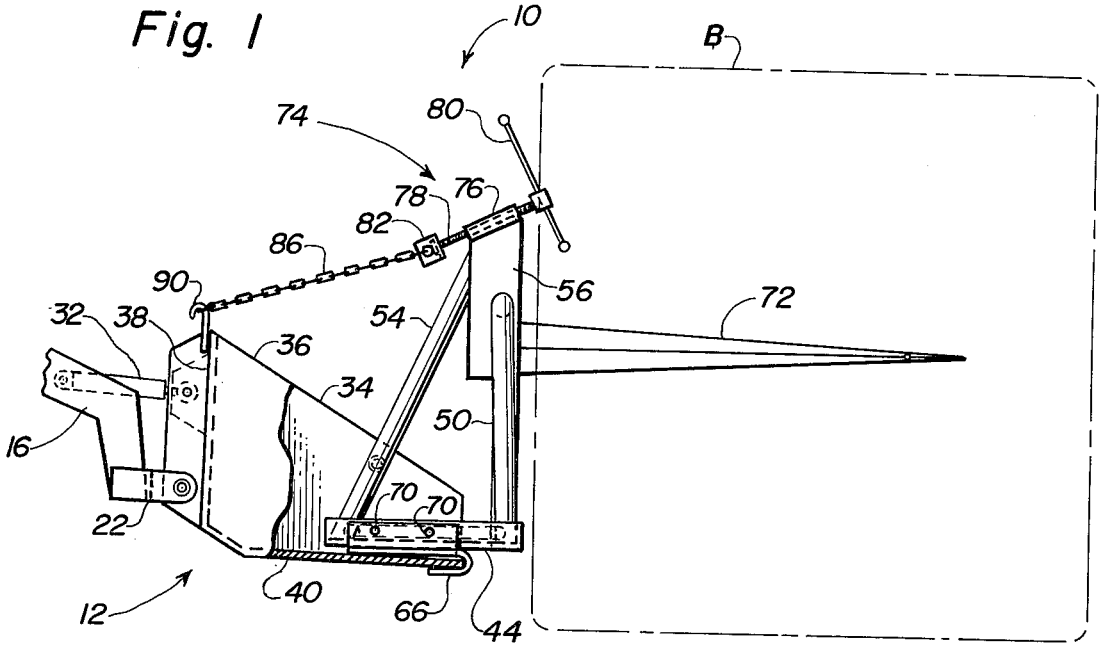
FIG. 1 is a side elevational view of a converter attachment for a bucket loader incorporating the principles of the present invention with the right side wall of the bucket being partially broken away and with the bale tine supporting a large round bale which is represented by phantom lines.
Figure 2:
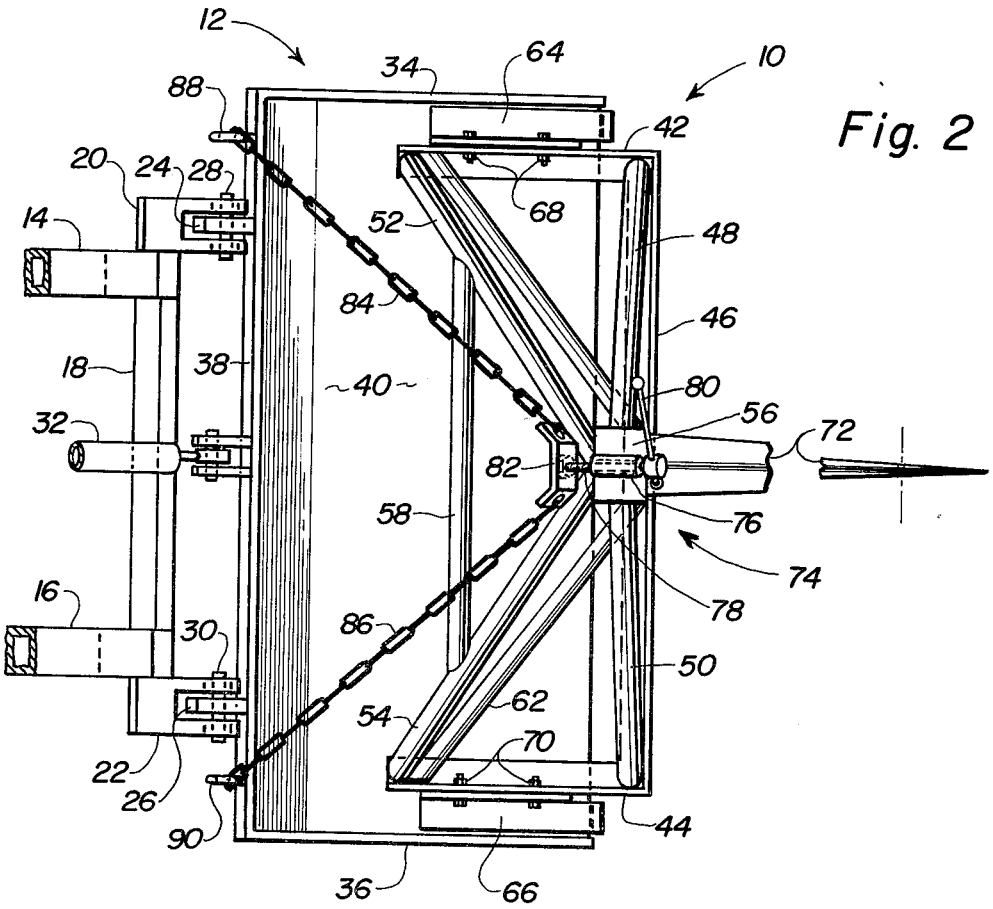
FIG. 2 is a fragmentary top plan view of the converter attachment of FIG. 1, but on a somewhat larger scale.

Referring now to the drawings, and particularly to FIGS. 1 and 2, there is shown a converter unit, being indicated generally by the numeral 10, attachably supported on the bucket 12 of a bucket loader, only the forward portion of the loader is shown in the drawings. Bucket loaders, sometimes referred to as front-end loaders, are well-known in the art and are basically of two common types, one type being of more-or-less integral construction, such as a payloader or skid-steer loader, whereas the other type of bucket loaders are separate implements that mount a loader structure on a tractor.

Since neither the loader nor its bucket form any part of this invention, it should suffice to say that for the sake of simplicity and clarity, only the forward portion of one type of a conventional loader structure is illustrated. The loader includes respective left and right lift arms 14, 16 with the forward ends thereof being interconnected by a cross member 18. Mounted on the sides of the lift arms 14, 16 are left and right bifurcated bucket connecting brackets 20, 22 which receive a respective pair of connecting plates 24, 26 secured to the rear wall of the bucket for pivot connection of the bucket to the left arms by connecting pins 28, 30. A hydraulic cylinder 32, pivotally connected between the bucket and the boom structure of the loader is actuable for pivoting the bucket 12 about a horizontal axis, defined by coaxial pivot pins 28, 30 during loading and discharging the bucket. As best seen in FIG. 2, the bucket 12 is comprised of left and right side walls 34, 36 respectively, a rear wall 38, and a bottom wall or floor 40. There are other bucket configurations, the one shown being merely illustrative for the purposes of better understanding the attaching operation of the converter unit 10 which will now be discussed in further detail.

Still referring to FIGS. 1 and 2, the converter unit 10 includes a generally upright frame structure having a lower base portion constructed from transversely spaced left and right angle members 42, 44 rigidly interconnected at their forward ends by a front angle member 46. Extending upwardly from each of the two corners formed by the side members 42, 44 and front member 46 is a strut of tubular configuration which slopes inwardly toward a fore-and-aft directed vertical plane that passes through the midsection of the front angle member 46, the left front strut being referred to by the numeral 48 and the right front strut being referred to by the numeral 50. The rearward ends of the side angle members 42, 44 support respectively left and right rear struts (also of tubular configuration) 52, 54 that project diagonally upwardly therefrom toward the upper arch of the front struts 48, 50. The upper ends of the front struts 48, 50 are secured to the opposite sides of a support column 56 while the upper ends of rear struts 52, 54 are secured, by welding or the like, to the rear face of the column 56, as best seen in FIG. 2. In the preferred embodiment, the column 56 is formed by welding together two lengths of channel irons to form a box shaped structure with the one length of channel iron extending to the front lower base member 46 (not seen) and with the other channel iron being approximately half the length and secured to the upper portion of the other channel iron. For added structural rigidity, the upright frame structure further includes a tubular cross brace 58 extending horizontally between the rear struts 52, 54 and disposed a short distance above the lower ends of each of the struts. Additionally, for frame structure rigidity, diagonal tubular braces 60, 62 are provided, with brace 60 extending horizontally from the rear corner of lower side member 42 to the mid portion of lower front member 46 and with brace 62 extending from the rear corner lower side member 44 to the mid portion of lower front member 46.

Figure 5:
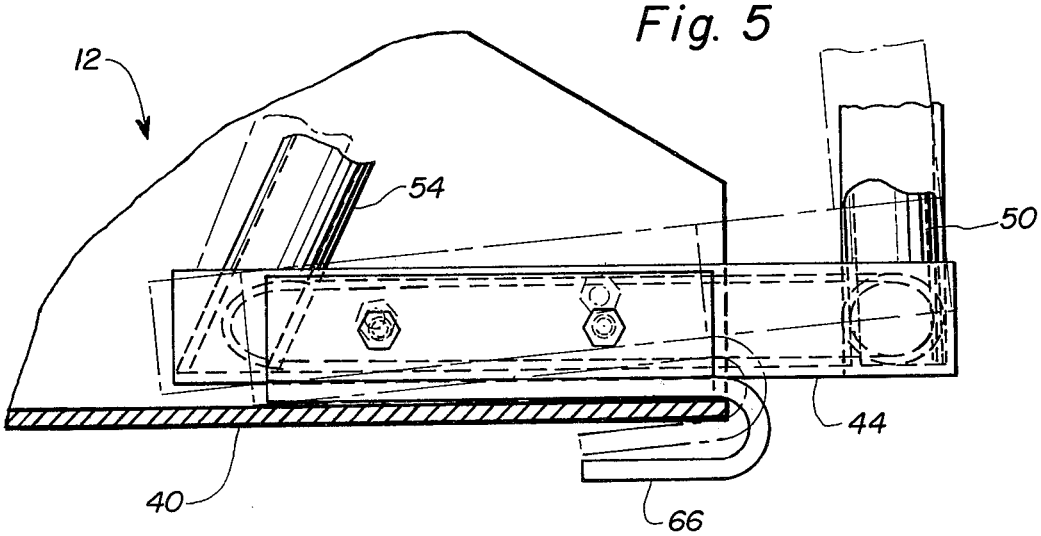
FIG. 5 is an enlarged fragmentary side elevational view of the lower portion of the frame structure of the converter attachment of FIG. 1 showing the relative position of the bucket and the frame structure when the bucket is driven into the frame structure and after the tensioning chains are tightened so as to firmly anchor the attachment on the bucket.

For retaining the upright frame structure on the floor 40 of bucket 12, means in the form of a pair of slotted brackets 64, 66 are provided on the lower base portion of the frame structure for releasably receiving the forward edge of the floor 40 of bucket 12. Brackets 64, 66 are curved in a U-shaped manner and oriented such that their openings face the forward edge of the bucket floor 40. As best seen in FIG. 5, the slotted openings of brackets 64, 66 are of a distance greater than the thickness of the floor 40 and is sufficient to loosely receive the forward edge of the floor 40. Again referring to FIGS. 1 and 2, bracket 64 is suitably fastened, by fastening bolts 68, on the left side of the frame structure to the lower left side angle member 42 and bracket 66 is fastened on the right side of the frame structure to the lower right side angle member 44 by fastening bolts 70. It should be pointed out here that the bracket 64, 66 are only one type of means for receiving the forward edge of the bucket floor, there being several way to accomplish this function, all of which are considered part of this invention. For example, there could be more than two such brackets for receiving the floor, or in the alternative, there could be one continuous bracket, and still further, instead of fastening the brackets to frame structure, the receiving of the floor may be achieved by an integral curved member of the frame structure.

With specific reference to FIG. 1, mounted on and projecting forwardly from an upper portion of the frame structure is one type of load support member 72 encompassed by the present invention. More particularly, the load support member 72 takes the form of a spear-shaped fork or tine adapted to engage a large round bale, such as bale B represented by the phantom lines. The bale engaging tine 72, as shown, is suitably fastened, such as by welding to the front face of the box shaped column 56 at an upper position thereof, approximately at the location on column 56 where the front struts 48, 50 are secured to the column. The exact shape and configuration of the bale engaging tine 72 is not limiting, it being well recognized that other shapes and forms a bale tine suitable for engaging a large round bale can also be used. Furthermore, the bale tine 72 is shown as being fixedly secured by welding to column 56; however, it is contemplated within this invention that the load support member or tine 72 may be removably mounted for interchanging one type of load support member 72 for another type such as the one shown in FIG. 4. The mounting and interchangeability of one load support member for another will be discussed again later on in this specification.

Still referring to FIGS. 1 and 2, the converter unit 10 further includes flexible link means interconnecting the upper portion of the frame structure with the bucket 12 and means for adjusting the tension in the flexible link means between a taut mode wherein the converter unit 10 is securely anchored on the bucket 10 such that the load support member 72 acts as an integral extension of the bucket 12 and a slack mode wherein the tension in the flexible link means is relaxed so as to permit easy removal of the converter unit 10 from the bucket 12. In the preferred embodiment, the tensioning means is represented by a turnbuckle, generally indicated by the numeral 74, having a stationary portion 76 mounted on the top of column 56 and a moveable portion 78 adapted to move in the fore-and-aft direction relative to the stationary portion 76. The stationary portion 76 has an internal threaded bore and the moveable portion 78 is externally threaded and moves back and forth through the threaded bore by rotation of the handle 80 provided on the forward end of the threaded moveable portion 78. Fixed on the rearward end of the moveable portion 78 is a connecting bracket 82. Also, in the preferred embodiment, the flexible link means is represented by two chains 84, 86. Chain 84 extends diagonally rearwardly from the connecting bracket 82 toward the left rear corner of the bucket 12 for attachment on chain hook 88 mounted on the top edge of the bucket rear wall 38 and chain 86 extends diagonally rearwardly from bracket 82 toward the right rear corner of bucket 12 for attachment with chain hook 90 also mounted on the top edge of rear wall 88. As easily and well understood the attachment of chains 84, 86 with respective chain hooks 88, 90 is easily performed by looping the end of the chain about the hook. Once the chains 84, 86 are attached to hooks 88, 90, the turnbuckle 74 is operated to tighten the chains.

It is preferred that the transverse distance between the rearward ends of chains 84, 86 be greater than the transverse distance between the forward ends of the chains so as to stabilize the frame structure of the converter unit 10 as well as the load, such as bale B, supported on the support member 72 on the bucket 12. It can be appreciated that the chains 84, 86, in addition to providing for quick connect-disconnect of the converter unit 10 on the bucket 12, they also tend to absorb and distribute the forces generated in transporting a load supported on the converter unit 10 and moved by the loader. This is contrary to a rigid member wherein the forces would be transmitted directly to the rear wall of the bucket, causing severe stress and strain thereto which could result in costly damage to the bucket.

As can be easily understood from the above, the converter unit 10 can be easily connected and disconnected on the bucket 12. In making the connection, the bucket 12 is driven under the lower portion of the frame structure such that the floor 40 of the bucket is received within brackets 64, 66. Chains 84, 86 are then hooked around the respective chain hooks 88, 90 and the turnbuckle 74 is actuated to remove the slack from the chain. Actuation of the turnbuckle is accomplished by rotating handle 80 in a clockwise direction so that the movable portion 76 of the turnbuckle 74 is threaded into its stationary portion 78. This shortens the effective length of the turnbuckle 74 and in turn removes the slack in the chains, placing them in a taut condition or mode. As can be seen the chains require no specific alignment position of the bucket with the converter unit. For the disconnect operation, handle 80 is turned in a counter-clockwise direction, which lengthens the turnbuckle 74 and relax as the tension in the chains 84, 86 to thereby permit the removal of the ends of the chains from around the hooks 88, 90. The bucket 12 is then free to be moved away from the converter unit 10.

As seen in FIG. 5, the frame structure rests initially flatly on the floor 40 of bucket 12, as represented by the dashed lines, when the chains 84, 86 are in their slack mode; however, when the chains 84, 86 are placed in their taut mode, the frame structure pivots about the rear portion of side members 42, 44 slighly rearwardly (in a counter-clockwise direction as facing the right side as viewed in FIGS. 2 and 5) until the forward edge of the floor 40 firmly abuts the upper surface and of the lower legs of brackets 64, 66. Thus, it can be seen that when the floor 40 of bucket 12 firmly abuts the brackets 64, 66 and when the chains 84, 86 are in a taut condition or mode, the converter unit 10 acts as an integral extension of the bucket 12.

Before going further, it should be pointed out that the tensioning means is not to be limited to the turnbuckle 74, but includes other such flexible link tightening or adjusting mechanisms, such as, but not limited to, a chain binder, a cable winch, a scissor jack device or the like. Any of such flexible link binders or tighteners can be either connected directly to the flexible link or be disposed between the flexible links and the frame structure or the bucket as described above. Further, the flexible link means need not be limited to two chains, but could be one chain, or one continuous chain connected at one end to the bucket and passing through a clevis which would be substituted for the connecting bracket 82 and then with the other end of the chain being attached to the opposite side of the bucket. With this latter type of arrangement, the chains would become self adjusting such that each length from the clevis to the bucket would become equal as the chain is tightened by the tension means, thus reducing the possibility of improper load adjustment or positioning of the frame structure which may be caused by unequal lengths of two separate chains. Still further, the flexible links may take the form of wire or rope cables, either one or two separate cables being used in the manner described above.

MODIFICATION AND ALTERNATIVE EMBODIMENTS

Figure 3:
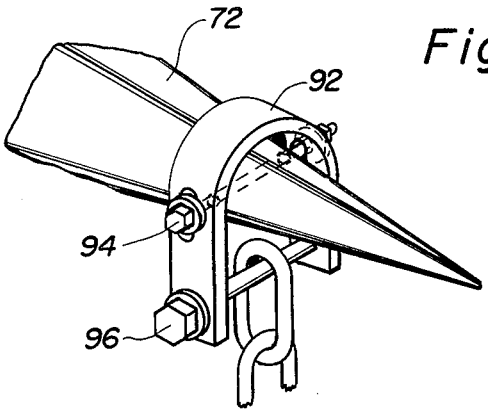
FIG. 3 is a fragmentary perspective view of the forward end of the bale tine with a chain hoist yoke mounted thereon to thereby convert the bale tine attachment to yet another use.

FIG. 3, shows, in perspective, the forward end of the bale engaging tine 72 with means for modifying the bale tine converter unit 10 from its intended use as a large bale handler to use as a hoist or lifting device. A yoke 92 is provided for attachment to the end of bale tine 72 by a clamping pin 94 that passes through apertures provided in the legs of the yoke 92 as well as an aperture in the end of the tine. The apertures in the legs of the yoke 92 are slotted such that the bight section of the yoke rests on the top curved surface of the tine 72 whereby any load to be lifted is transferred directly to the tine 72 and not the clamping bolt 94 which would easily be snapped or broken. A rod or bolt 96 passes through the free end of yoke 92 for attaching a chain sling (not shown) or other such device for handling drainage pipe, logs, or similar such items. As appreciated, the converter unit 10 as shown in FIG. 1 which converts the bucket loader from the use of transferring bulk materials to one for handling large round bales, has now been easily converted again, as seen in FIG. 3, for use as a hoist for lifting loads from one location to another.

Figure 4:
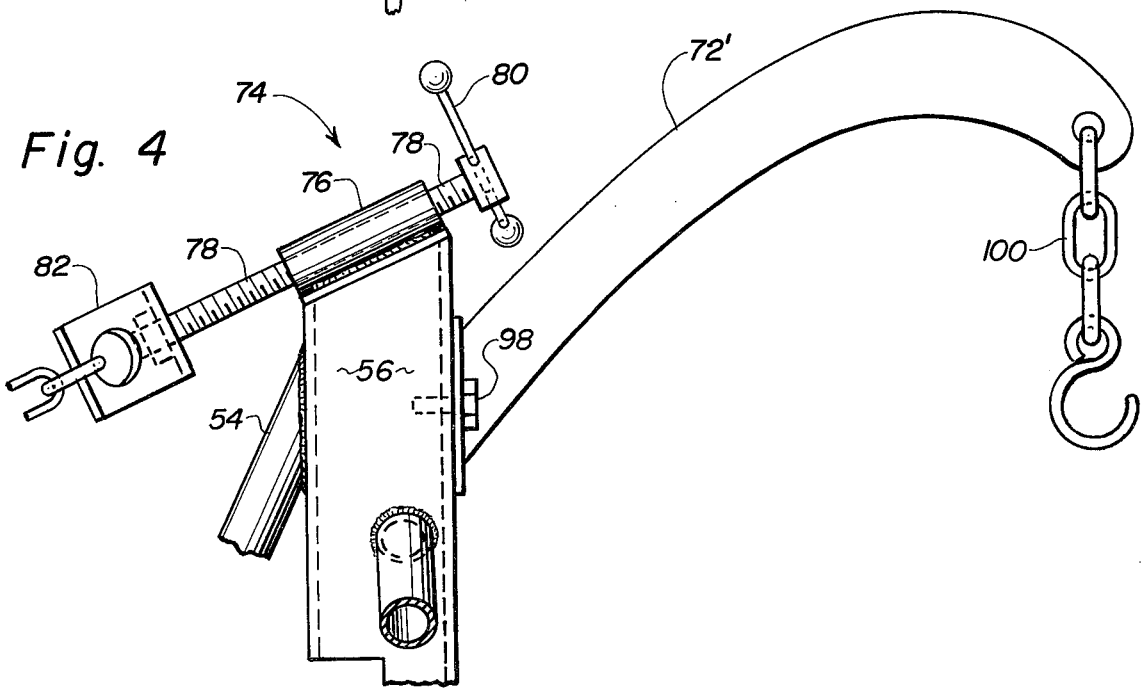
FIG. 4 is a fragmentary side elevational view of an alternative embodiment of the converter attachment of FIG. 1 in which the load support member now is represented as a boom arm.

An alternative embodiment of the converter unit 10 is shown in FIG. 4. The frame structure, turnbuckle and other components are the same as the unit 10 seen in FIGS. 1 and 2, but with the difference being that the load support member takes the form of a boom arm 72' which is removeably mounted to the upper portion of the frame structure by attaching bolts 98, only one of which is shown. The boom arm 72' projects forwardly from the front face of column 56 and extends upwardly a short distance above the top of the frame structure and then curves slightly downwardly wherein a chain 100 is attached to the distal end. The chain 100 is for the purpose of further attachment to a chain swing or other load moving device. The boom arm 72' is merely for exemplary purposes to show another type of tool which could be used in conjunction with the frame structure in making up the converter unit 10 whereby the bucket loader, through use of the converter 10, can perform yet another operation or use.

As appreciated, the removeable mounting of the load support member on the frame structure adds still further versatility, permitting one type of load support member, such as the bale tine 72 which performs one type of operation (bale handling) with another type of load support member, such as boom arm 72' which performs yet another different type of operation (a hoist). Such interchangeability of one load support member for another saves an operator the costs of owning two separate converter units which perform different functions.

It is thought that the invention and many of its attendant advantages will be understood from the foregoing description and it will be apparent that various changes may be made in form, construction and arrangement thereof without departing from the spirit and scope of the invention or sacrificing all of its material advantages, the form hereinbefore described being merely a preferred or exemplary embodiment thereof.

What is claimed is:

1. A bucket loader attachment adapted to be releasably secured to a bucket of a front end loader, said bucket having a floor and an upper portion, said attachment comprising:

(a) a generally upright frame structure having a lower rectangular base portion adapted to rest on the floor of the bucket;

(b) a load support member mounted on an upper portion of said frame structure and extending forwardly therefrom for supporting a load on said front end loader;

(c) means along said base portion for releasably receiving the forward edge of the floor of said bucket;

(d) flexible link means interconnecting said upper portion of said frame structure with said upper portion of said bucket; and (e) tension means connecting said link means and one of said upright frame structure or said bucket for adjusting tension in said link means so as to firmly anchor a rear edge of said base portion of said frame structure on the floor of said bucket such that said load support member acts as an integral extension of said bucket and such that when said attachment is releasably secured on said bucket, said flexible link means takes on a V-shaped configuration with its vertex being connected to said tension means and with its legs being attached to transversely spaced locations on said upper portion of said bucket.

2. The attachment as defined in claim 1, wherein said load support member is a spear-shaped tine adapted to engage a large round bale or the like for transport of same on said front end loader.

3. The attachment as defined in claim 1, wherein said load support member is a curved boom arm that projects upwardly a distance greater than the height of said upright frame structure and then curves downwardly therefrom a small distance.

4. The attachment as defined in claim 1, wherein said releasably receiving means includes a pair of transversely spaced U-shaped brackets being oriented such that the openings of said brackets face the forward edge of said floor of said bucket and with the openings being of a dimension greater than the thickness of said bucket floor so as to receive said floor therewithin, one bracket being secured to one lateral side of said frame structure base portion whereas the other one of said brackets being secured to the opposite lateral side of said frame structure base portion.

5. The attachment as defined in claim 1, wherein said flexible link means includes at least one chain.

6. A bucket loader attachment adapted to be releasably secured to a bucket of a front end loader, said bucket having a floor and an upper portion, said attachment comprising:

(a) a generally upright frame structure having a lower rectangular base portion adapted to rest on the floor of the bucket;

(b) a load support member mounted on an upper portion of said frame structure and extending forwardly therefrom for supporting a load on said front end loader;

(c) means along said base portion for releasably receiving the forward edge of the floor of said bucket;

(d) flexible link means interconnecting said upper portion of said frame structure with said upper portion of said bucket;

(e) tension means connecting said link means and one of said upright frame structure or said bucket for adjusting tension in said link means so as to firmly anchor a rear edge of said base portion of said frame structure on the floor of said bucket such that said load support member acts as an integral extension of said bucket; and (f) said tension means including a turnbuckle having a stationary portion fixably secured to said upper portion of said frame structure and a moveable portion being attached to said flexible link means, said turnbuckle being operable to adjust the tension of said link means whereby the tension of said link means can be increased so as to firmly anchor said attachment on said bucket and whereby the tension of said link means can be relaxed from its anchoring mode so as to facilitate the removal of said attachment from said bucket.

7. The attachment as defined in claim 6, wherein said flexible link means includes two fore-and-aft extending chains each having one end thereof being connected to said upper portion of said frame structure at a location approximate the mid-section of said bucket with the other ends of the respective chains being attached to said upper portion of said bucket along transversely spaced locations such that one chain extends in a diagonal direction from said frame structure toward one side of said bucket whereas the other chain extends in an opposite diagonal direction from said frame structure toward the opposite side of said bucket.

8. The attachment as defined in claim 7, wherein said other ends of said chains are attached to said bucket by looping the respective ends of said chains around a respective pair of chain hooks mounted on the top edge of said upper portion of said bucket.

9. A bucket attachment adapted to be releasably secured to a bucket of a front end loader, said bucket having a floor and an upper portion, said attachment comprising:

(a) a generally upright frame structure having a lower base portion adapted to rest on the floor of said bucket;

(b) a tine member attached to an upper portion of said frame structure and extending forwardly therefrom for engaging a large round bale or the like;

(c) clamp means along said base portion for releasably receiving at least a portion of the forward edge of said bucket;

(d) flexible link means interconnecting said upper portion of said frame structure with said bucket;

(e) tension means operably associated with said flexible link means for adjusting the tension in said link means between a taut mode whereby said frame structure is firmly anchored on said bucket such that said tine member acts as an integral extension of said bucket in handling large round bales and a slack mode whereby the tension in said link means is relaxed so as to facilitate removal of said attachment from said bucket; and (f) said tension means including a turnbuckle interposed between said flexible link means and said frame structure, said turnbuckle having a stationary portion fixably secured to said upper portion of said frame structure and a moveable portion connected to said flexible link means and moveable in a fore-and-aft direction relative to said stationary portion so as to adjust the tension of said flexible link means.

10. The attachment as defined in claim 9, wherein said flexible link means include a pair of chains, the corresponding forward ends of said chains being interconnected to said upper portion of said frame structure whereas the corresponding rearward ends of said chains being attached to said upper portion of said bucket.

11. The attachment as defined in claim 10, wherein said flexible link means further includes a pair of transversely spaced hooks mounted on said upper portion of said bucket, said rearward ends of said pair of chains being hooked around respective ones of said hooks.

12. The attachment as defined in claim 10, wherein the transverse distance between the rearward ends of said chains is greater than the transverse distance between the forward ends of said chains so as to enchance the stability of said frame structure on said bucket when a large round bale is being supported on said tine member.

* * * * *